US009121587B2

(12) United States Patent
Huang

(10) Patent No.: US 9,121,587 B2
(45) Date of Patent: Sep. 1, 2015

(54) LED LAMP ASSEMBLY

(71) Applicant: Tsung-Hsien Huang, I-Lan Hsien (TW)

(72) Inventor: Tsung-Hsien Huang, I-Lan Hsien (TW)

( * ) Notice: Subject to any disclaimer, the term of this patent is extended or adjusted under 35 U.S.C. 154(b) by 130 days.

(21) Appl. No.: 13/665,845

(22) Filed: Oct. 31, 2012

(65) Prior Publication Data

US 2013/0335978 A1 Dec. 19, 2013

(30) Foreign Application Priority Data

Jun. 13, 2012 (CN) ..... 2012 1 0194026

(51) Int. Cl.

| | |
|---|---|
| ***F21V 29/00*** | (2006.01) |
| ***F21V 17/16*** | (2006.01) |
| ***F21K 99/00*** | (2010.01) |
| ***F21V 29/77*** | (2015.01) |
| *F21V 3/00* | (2015.01) |
| *F21Y 101/02* | (2006.01) |

(52) U.S. Cl.

CPC ..... *F21V 17/16* (2013.01); *F21K 9/135* (2013.01); *F21V 29/773* (2015.01); *F21V 3/00* (2013.01); *F21Y 2101/02* (2013.01); *Y10T 29/49002* (2015.01)

(58) Field of Classification Search

CPC ..... F21K 9/135; F21V 17/16; F21V 29/773; F21V 3/00; F21V 29/004; F21V 29/2293; F21V 29/02

USPC ..... 362/373, 363, 351, 311.02, 311.01, 362/294; 165/80.1–80.3, 104.14, 104.33; 313/45–46

See application file for complete search history.

(56) References Cited

U.S. PATENT DOCUMENTS

| | | | | |
|---|---|---|---|---|
| 7,631,987 | B2 * | 12/2009 | Wei | 362/294 |
| 7,918,587 | B2 * | 4/2011 | Hsu et al. | 362/294 |
| 7,992,624 | B2 * | 8/2011 | Huang | 165/80.3 |
| 2010/0270014 | A1 * | 10/2010 | Huang | 165/183 |

* cited by examiner

*Primary Examiner* — Stephen F Husar
*Assistant Examiner* — Naomi M Wolford
(74) *Attorney, Agent, or Firm* — Pai Patent & Trademark Law Firm; Chao-Chang David Pai

(57) ABSTRACT

An LED lamp assembly includes a heat-sink base having insertion notches equiangularly and radially located at a flat inner wall thereof, and a plurality of radiation fins arranged in a radial array, each radiation fin having a plug portion disposed at a top side thereof and respectively inserted into one respective insertion notch of the heat-sink base and fixedly secured thereto using a stamping technique, a lampshade fastened to the radiation fins at the top side, and an insulative connector fastened to the radiation fins at the bottom side.

16 Claims, 10 Drawing Sheets

LED LAMP ASSEMBLY

BACKGROUND OF THE INVENTION (a) Field of the Invention

The present invention relates to LED lamp technology and more particularly to a LED lamp assembly, which comprises a heat-sink base holding a series of LED devices, and a set of radiation fins arranged in a radial array and fastened to a flat inner wall of the heat-sink base using a stamping technique.

(b) Description of the Prior Art

A conventional LED lamp assembly is comprises a radiation fin set, a heat-sink base, an insulative connector, LED devices, and a lampshade. Taiwan Utility Nos. M389826 and M419035 teach a way of connection between a radiation fin set and a heat-sink base. According to these two prior art designs, radiation fins are mounted around a tubular heat-sink base that holds a series of LED devices. During the operation of the LED devices, waste heat is transferred from the LED devices through the tubular heat-sink base to the radiation fins for dissipation into the outside open air.

Taiwan Utility No. M400660 or M413817 discloses another LED lamp bulb design. According to this design, a radiation fin set is fastened to a flat heat-sink base. The flat heat-sink base comprises a plurality of pins. Each radiation fin of the radiation fin set has a folded flange and a mounting hole at the folded flange. By means of forcing the respective mounting holes of the radiation fins of the radiation fin set into engagement with the respective pins of the flat heat-sink base, the radiation fin set and the flat heat-sink base are assembled together. However, after the radiation fin set and the flat heat-sink base are assembled, the folded flanges of the radiation fins may not be closely attached to the surface of the flat heat-sink base for quick transfer of waste heat, thus lowering the heat dissipation performance. In order to assure mounting stability, the mounting structure between the radiation fin set and the heat-sink base must have a high precision, and no deviation is allowed. The fabrication difficulty is likely to cause a high defective rate.

SUMMARY OF THE INVENTION

The present invention has been accomplished under the circumstances in view. It is the main object of the present invention to provide a LED lamp assembly, which has a simple structure that can easily be assembled using a stamping technique.

To achieve this and other objects of the present invention, a LED lamp assembly comprises a radiation fin set defining a top open side, a heat-sink base mounted in the top open side of the radiation fin set to hold light-emitting diode means, and an insulative connector fastened to the radiation fin set at a bottom side. The heat-sink base is a flat metal block member comprising opposing flat outer wall and flat inner wall, and a plurality of insertion notches equiangularly and radially located at the flat inner wall. The radiation fin set comprises a plurality of radiation fins arranged in a radial array. Each radiation fin comprises a plug portion disposed at a top side thereof and respectively inserted into one respective insertion notch of the heat-sink base and fixedly secured thereto using a stamping technique.

Further, the plug portion of each radiation fin is a folded plug portion having a folded part. The thickness of the folded plug portion of each radiation fin is smaller than the width of each insertion notch of the heat-sink base before insertion. The folded plug portions of the radiation fins are embedded in the respective insertion notches of the heat-sink base after application of the stamping technique.

Further, each radiation fin of the radiation fin set has a stepped structure at the top side thereof. The plug portion of each radiation fin is located at a middle part of the stepped structure of the respective radiation fin. Each radiation fin further comprises a horizontal protruding portion located at the stepped structure thereof and abutted against an inner side of the associated folded plug portion at a relatively lower elevation. The horizontal protruding portions of the radiation fins are respectively horizontally abutted against one another, forming an annular plane that is closely attached to the flat inner wall of the heat-sink base for rapid transfer of waste heat for quick dissipation into the outside open air.

Further, each radiation fin of the radiation fin set comprises an outer edge, and an upper locating notch located at the outer edge near the top side for the mounting of a lampshade, and a lower locating notch located at the outer edge near the bottom for the mounting of the insulative connector.

Further, in an alternate form of the present invention, each radiation fin of the radiation fin set comprises a narrow, elongated mounting flange perpendicularly extending from an inner side thereof, and an inner locating notch located at the narrow, elongated mounting flange near a bottom side of the narrow, elongated mounting flange. Further, the insulative connector comprises a rim extending around the periphery of a top side thereof and stopped against the radiation fins of the radiation fin set at a bottom side, and a plurality of hook rods protruding from the rim and respectively hooked in the inner locating notches of the radiation fins of the radiation fin set.

DETAILED DESCRIPTION OF THE PREFERRED EMBODIMENTS

Figure 1:
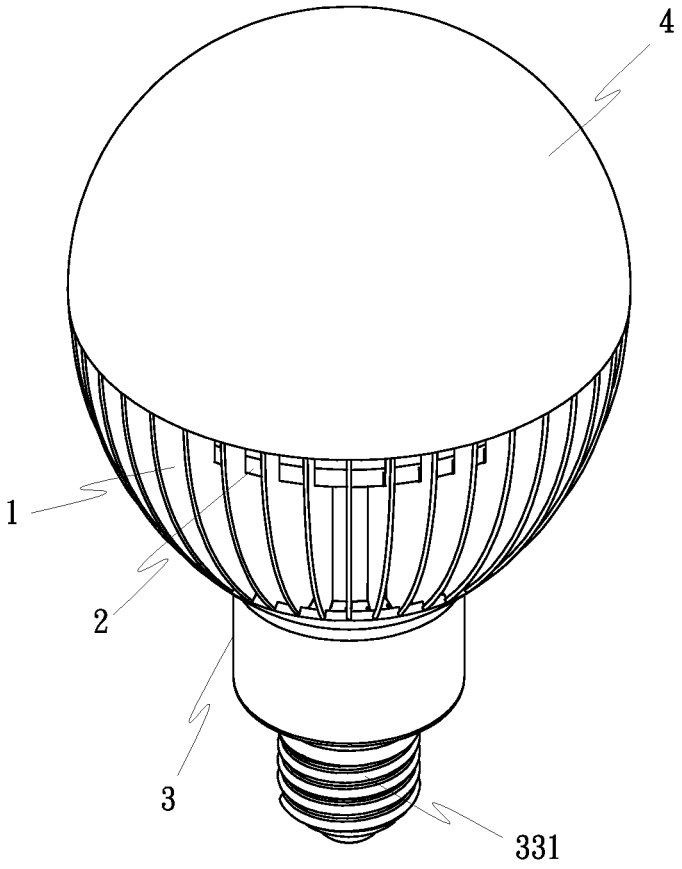
FIG. 1 is an elevational view of a LED lamp assembly in accordance with the present invention.
Figure 2:
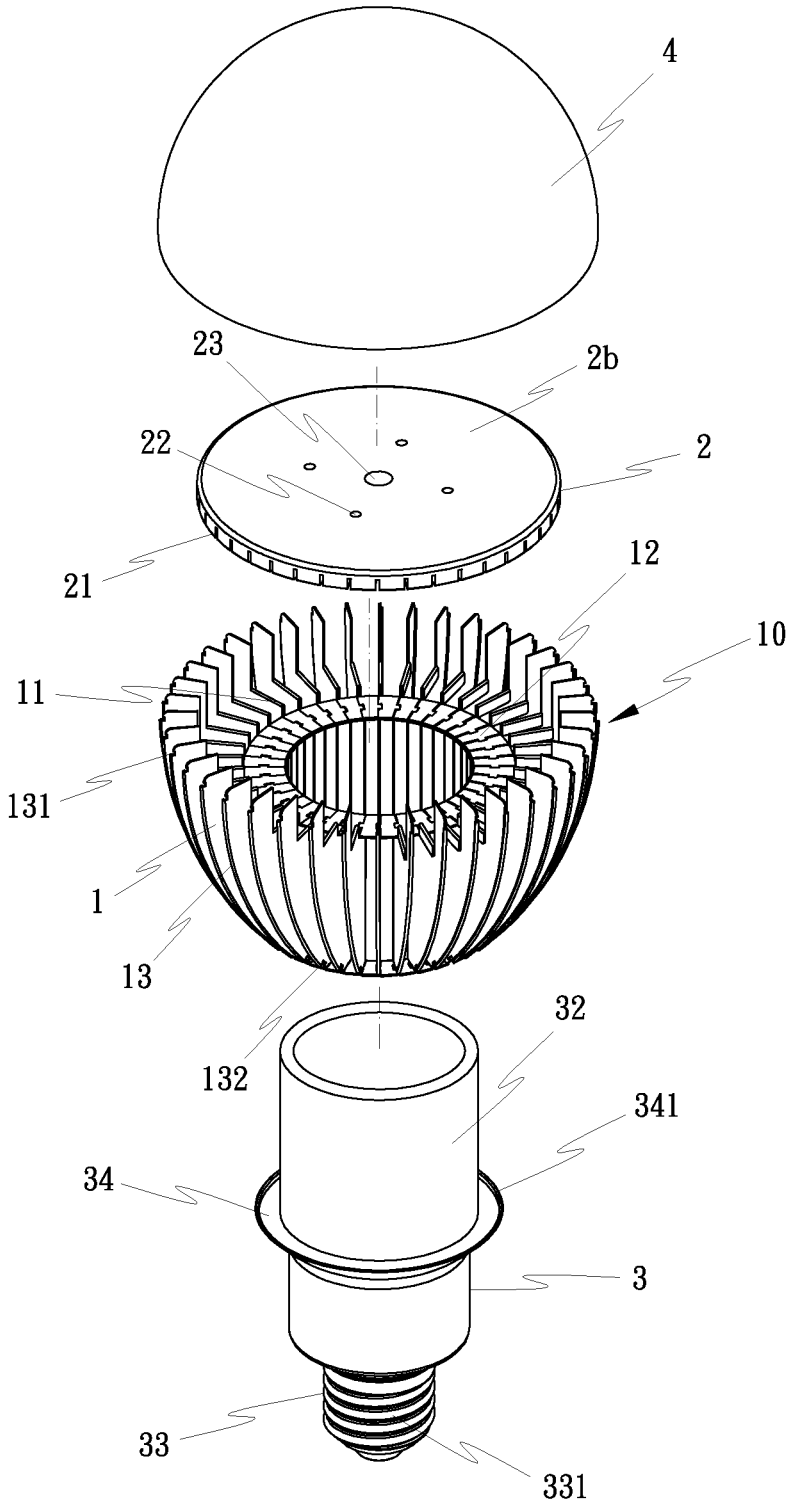
FIG. 2 is an exploded view of the LED lamp assembly in accordance with the present invention.

Referring to FIGS. 1 and 2, a LED lamp assembly in accordance with a first embodiment of the present invention is shown. The LED lamp assembly comprises a radiation fin set 10, a heat-sink base 2, an insulative connector 3, and a lampshade 4 fastened to a top open side of the radiation fin set 10.

The radiation fin set 10 comprises a plurality of radiation fins 1. Each radiation fin 1 defines a plug portion 11 at the top side thereof.

Figure 3:
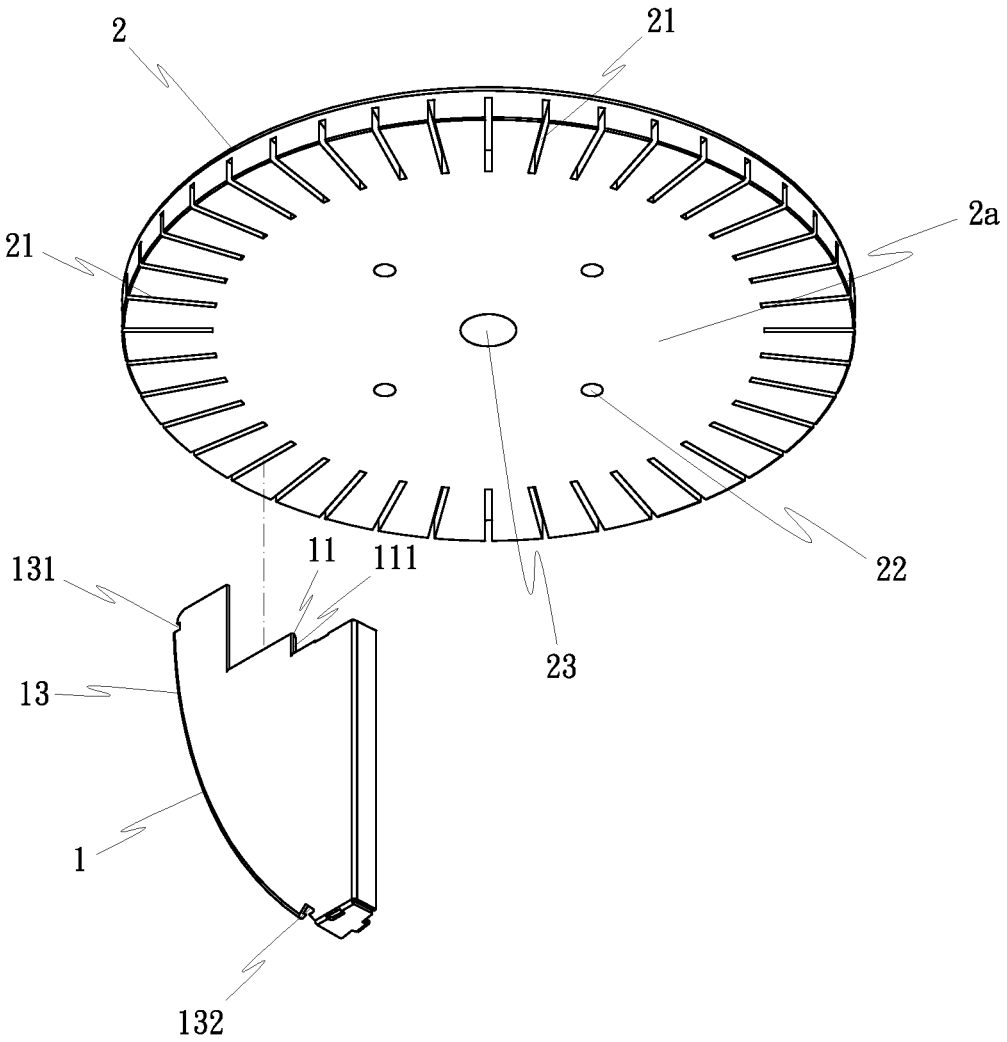
FIG. 3 is an exploded view of one radiation fin and the heat-sink base of the LED lamp assembly in accordance with the present invention.
Figure 4:
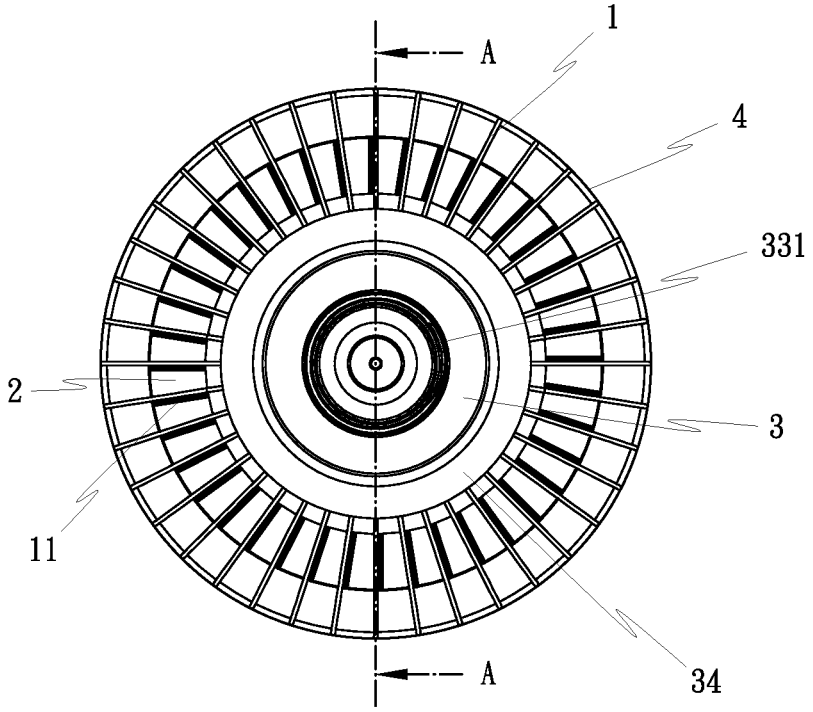
FIG. 4 is a bottom view of the LED lamp assembly in accordance with the present invention.

The heat-sink base 2 is a flat metal block member, comprising opposite flat inner wall 2*a* and outer wall 2*b*, a plurality of insertion notches 21 equiangularly and radially located at the flat inner wall 2*a* (see FIG. 3), a light-emitting unit formed of a series of LED devices (not shown) and mounted at the flat outer wall 2*b*, and a plurality of through holes 22; 23 cut through the opposing inner wall 2*a* and outer wall 2*b* for the passing of electrical wires (not shown) of the LED devices.

The insulative connector 3 is adapted to hold the radiation fin set 10.

When assembling the LED lamp assembly, insert the plug portions 11 of the radiation fins 1 into the respective insertion notches 21 of the heat-sink base 2, and then employ a stamping technique to deform the insertion notches 21, causing the plug portions 11 of the radiation fins 1 and the insertion notches 21 of the heat-sink base 2 to be fixedly fastened together. Thereafter, fasten the insulative connector 3 and the lampshade 4 to the opposing bottom side and top side of the radiation fin set 10.

As stated in the aforesaid embodiment, the present invention is characterized in that multiple insertion notches 21 are equiangularly and radially located at the flat inner wall 2*a* of the flat heat-sink base 2, and the respective plug portions 11 of the radiation fins 1 are respectively engaged into the insertion notches 21 of the flat heat-sink base 2 and fixedly secured thereto using a stamping technique. This installation procedure is rapid and simple, assuring a high level of stability.

Figure 5:
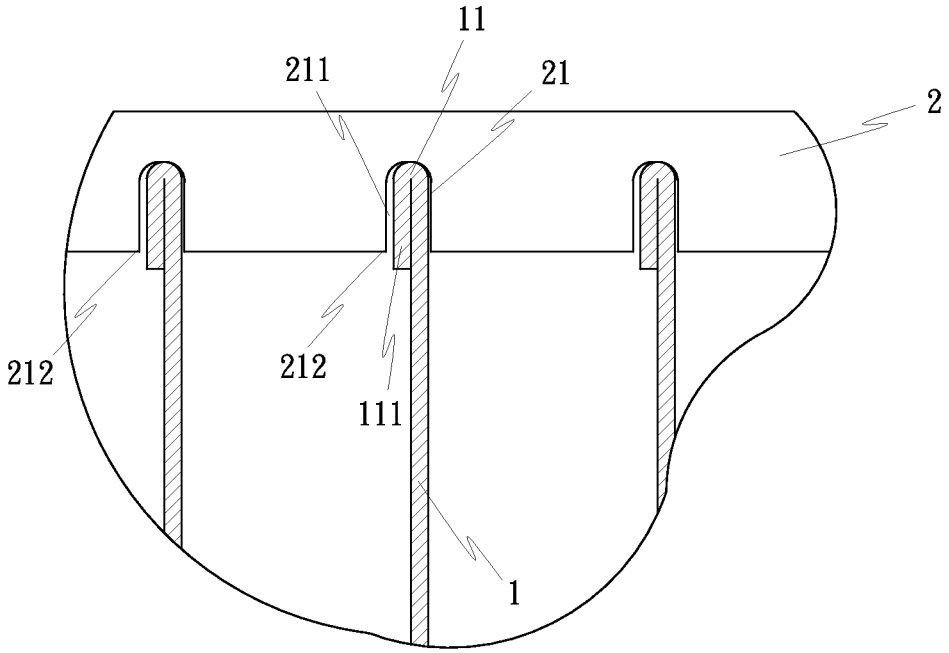
FIG. 5 is a schematic illustration of the plug portions of the radiation fins inserted into the respective insertion notches of the heat-sink base before stamping.
Figure 6:
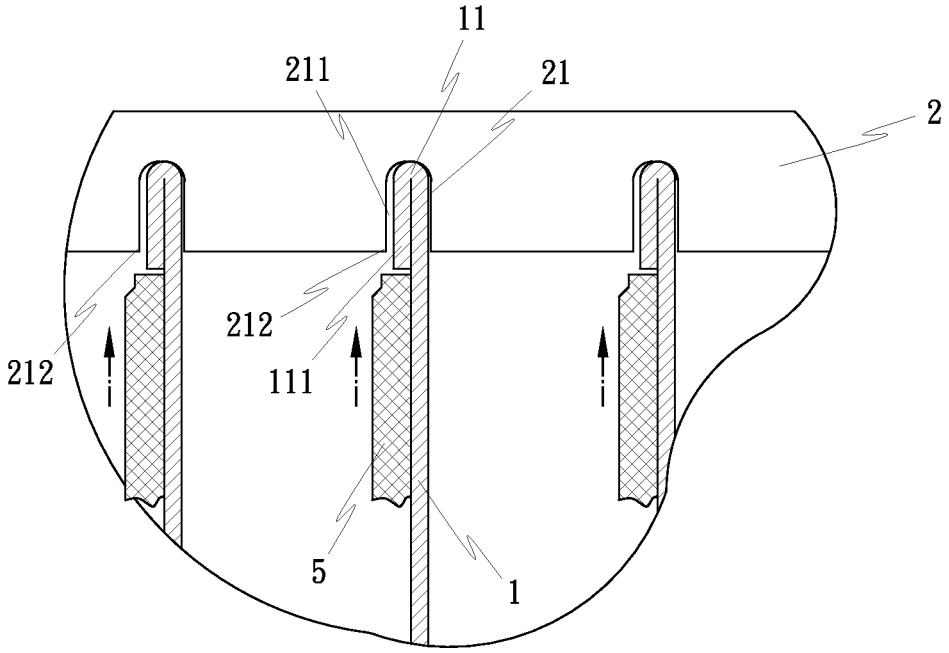
FIG. 6 corresponds to FIG. 5, illustrating respective stamping punches moved toward the plug portions of the respective radiation fins.
Figure 7:
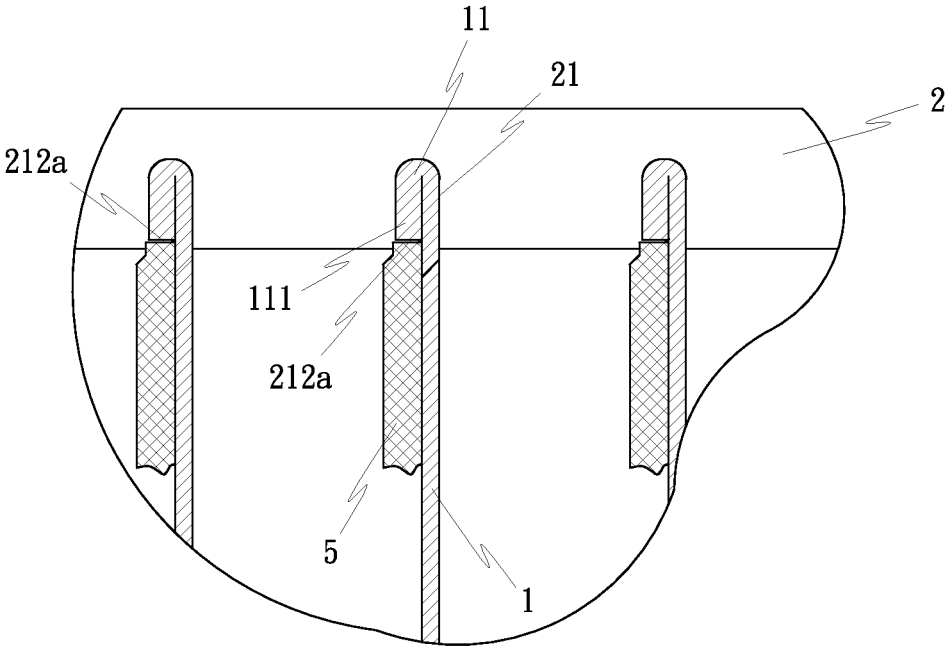
FIG. 7 corresponds to FIG. 6, illustrating the stamping punches stamped against the plug portions of the respective radiation fins.
Figure 8:
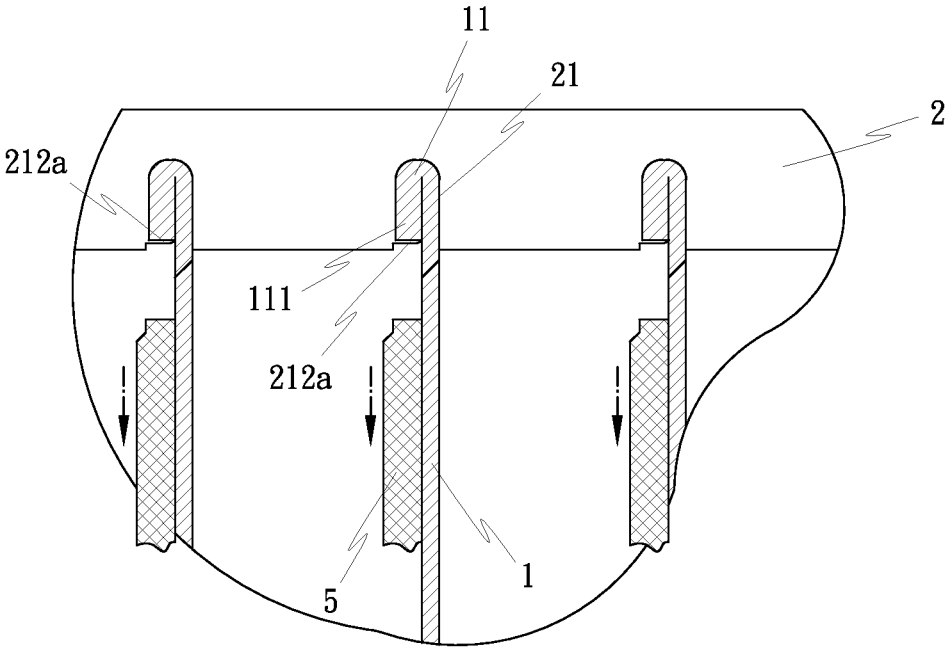
FIG. 8 corresponds to FIG. 7, illustrating the stamping punches moved away from plug portions of the respective radiation fins after stamping.

As illustrated in FIG. 5, the plug portion 11 of each radiation fin 1 is a double-layer (or multi-layer) folded plug portion having a folded part 111. The thickness of the double-layer (or multi-layer) folded plug portion 11 is slightly smaller than the width of each insertion notch 21 of the heat-sink base 2. After insertion of the plug portion 1 of each radiation fin 1 into one respective insertion notch 21 of the heat-sink base 2, a clearance 211 is left in the insertion notch 21 between the heat-sink base 2 and the plug portion 1 of the radiation fin 1. After insertion of the plug portions 11 of the radiation fins 1 into the respective insertion notches 21 of the heat-sink base 2 in a stamping press, as shown in FIGS. 6-8 (the stamping press is not shown), the stamping press is operated to stamp respective stamping punches 5 against the folded part 111 of the double-layer (or multi-layer) folded plug portion 11 of each respective radiation fin 1 and the heat-sink base 2, embedding the folded part 111 wholly in the respective insertion notch 21 to fill up the clearance 211, and deforming one lateral sidewall 212 of each insertion notch 21 to create a protrusion 212*a* that stops the folded part 111 of the double-layer (or multi-layer) folded plug portion 11 of the respective radiation fin 1 in the respective insertion notch 21. Thus, the radiation fins 1 are fixedly secured to the respective insertion notches 21 of the heat-sink base 2, and will not fall off or become loose.

Figure 9:
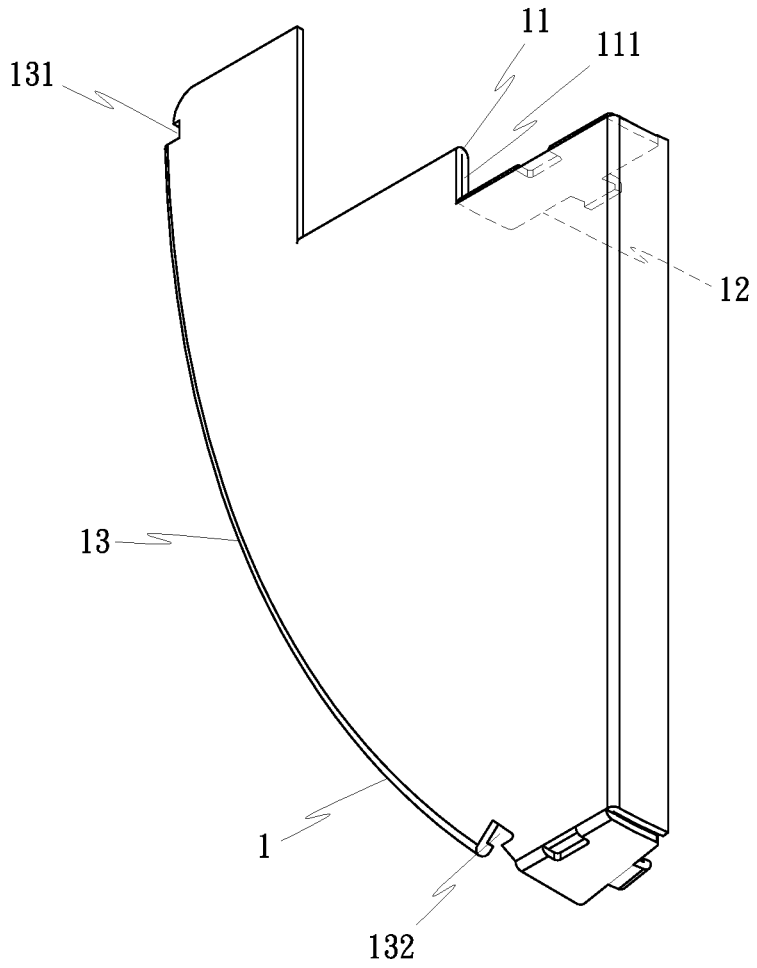
FIG. 9 is a perspective view in an enlarged scale of one radiation fin of the LED lamp assembly in accordance with the present invention.

Referring to FIG. 9, each radiation fin 1 has a stepped structure at the top side thereof. The folded plug portion 11 of each radiation fin 1 is located at a middle part of the stepped structure. Each radiation fin 1 further comprises a horizontal protruding portion 12 located at the stepped structure thereof and abutted against an inner side of the folded plug portion 11 at a relatively lower elevation. After the plug portions 11 of the radiation fins 1 are respectively affixed to the respective insertion notches 21 of the heat-sink base 2, the horizontal protruding portions 12 of the radiation fins 1 are respectively horizontally abutted against one another, forming an annular plane (see FIG. 2) that is closely attached to the flat inner wall 2*a* of the heat-sink base 2 for quick transfer of waste heat from the heat-sink base 2 for quick dissipation into the outside open air.

Referring to FIG. 9 again, each radiation fin 1 further comprises an outer edge 13, an upper locating notch 131 located at the outer edge 13 near the top side thereof, and a lower locating notch 132 located at the outer edge 13 near the bottom side thereof.

Figure 10:
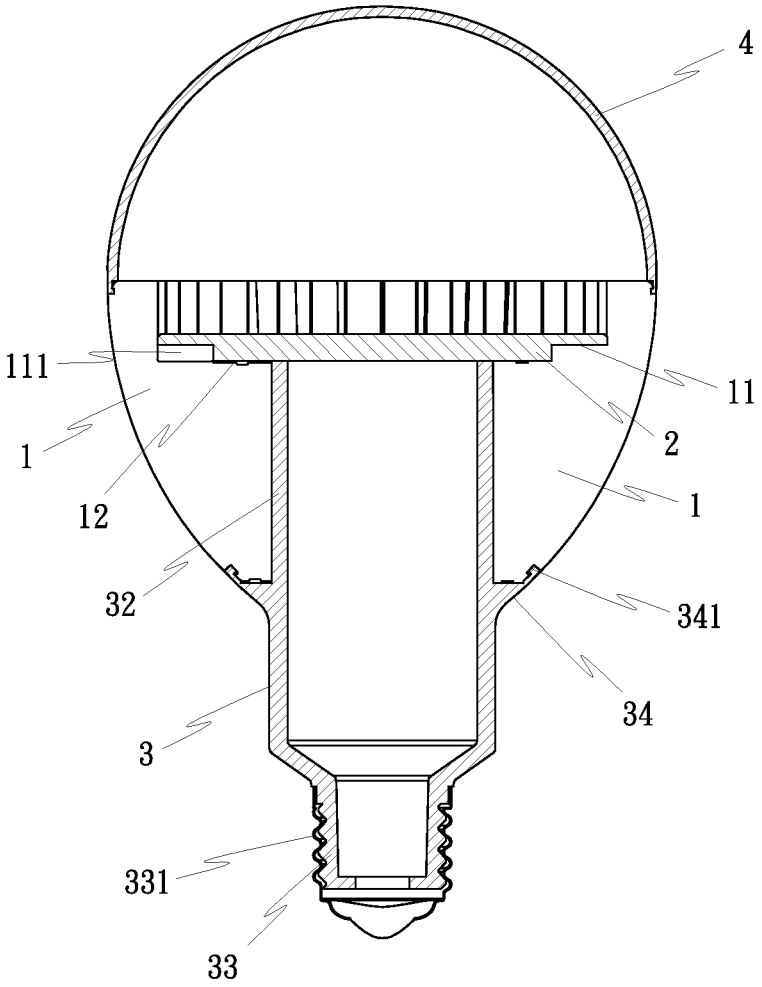
FIG. 10 is a longitudinal sectional assembly view of the LED lamp assembly in accordance with the present invention.

Referring to FIG. 10 and FIG. 9 again, after the radiation fins 1 and the heat-sink base 2 are affixed together, the lampshade 4 is attached to the radiation fin set 10 by forcing the flanged bottom edge of the lampshade 4 into engagement with the upper locating notches 131 of the radiation fins 1 of the radiation fin set 10, and then the insulative connector 3 is inserted vertically upwardly into the radiation fin set 10 and forced into engagement with the lower locating notches 132 of the radiation fins 1 of the radiation fin set 10.

Referring to FIGS. 1, 2 and 10 again, the insulative connector 3 comprises a tubular shaft 32 vertically upwardly inserted into the radiation fin set 10 and attached to the flat inner wall 2*a* of the heat-sink base 2, a lamp bulb base 33 externally threaded and provided with a metal conducting ring contact 331 and located at a bottom side of the tubular shaft 32 outside the radiation fin set 10, a rim 34 extending around the periphery of the tubular shaft 32, and a hooked portion 341 protruding from a border area of the rim 34 and forced into engagement with the lower locating notches 132 of the radiation fins 1 of the radiation fin set 10.

Figure 11:
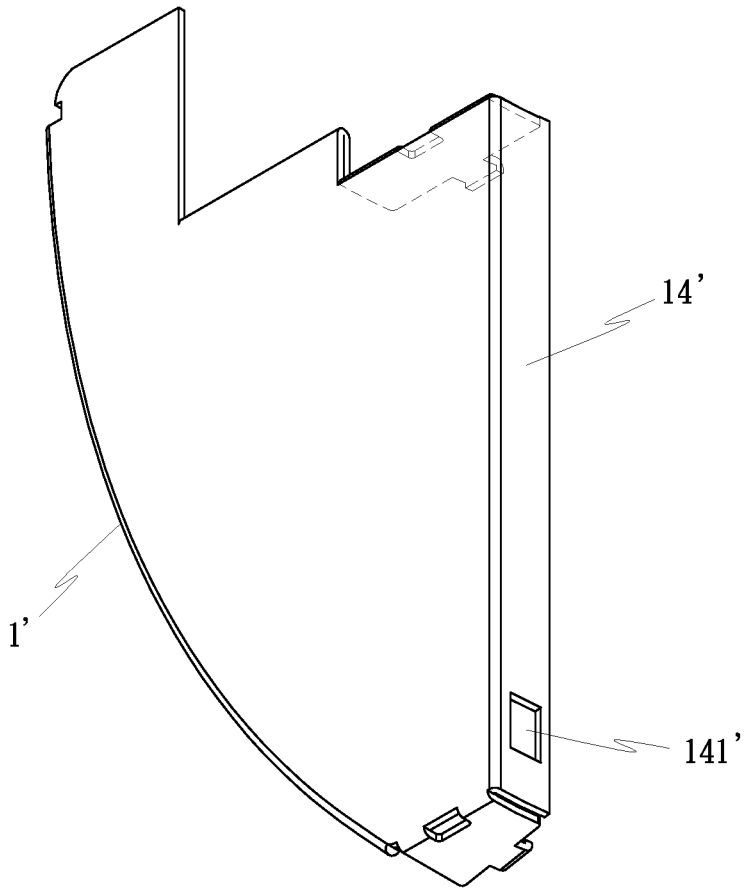
FIG. 11 is a perspective view in an enlarged scale of one radiation fin of an alternate form of the LED lamp assembly in accordance with the present invention.
Figure 12:
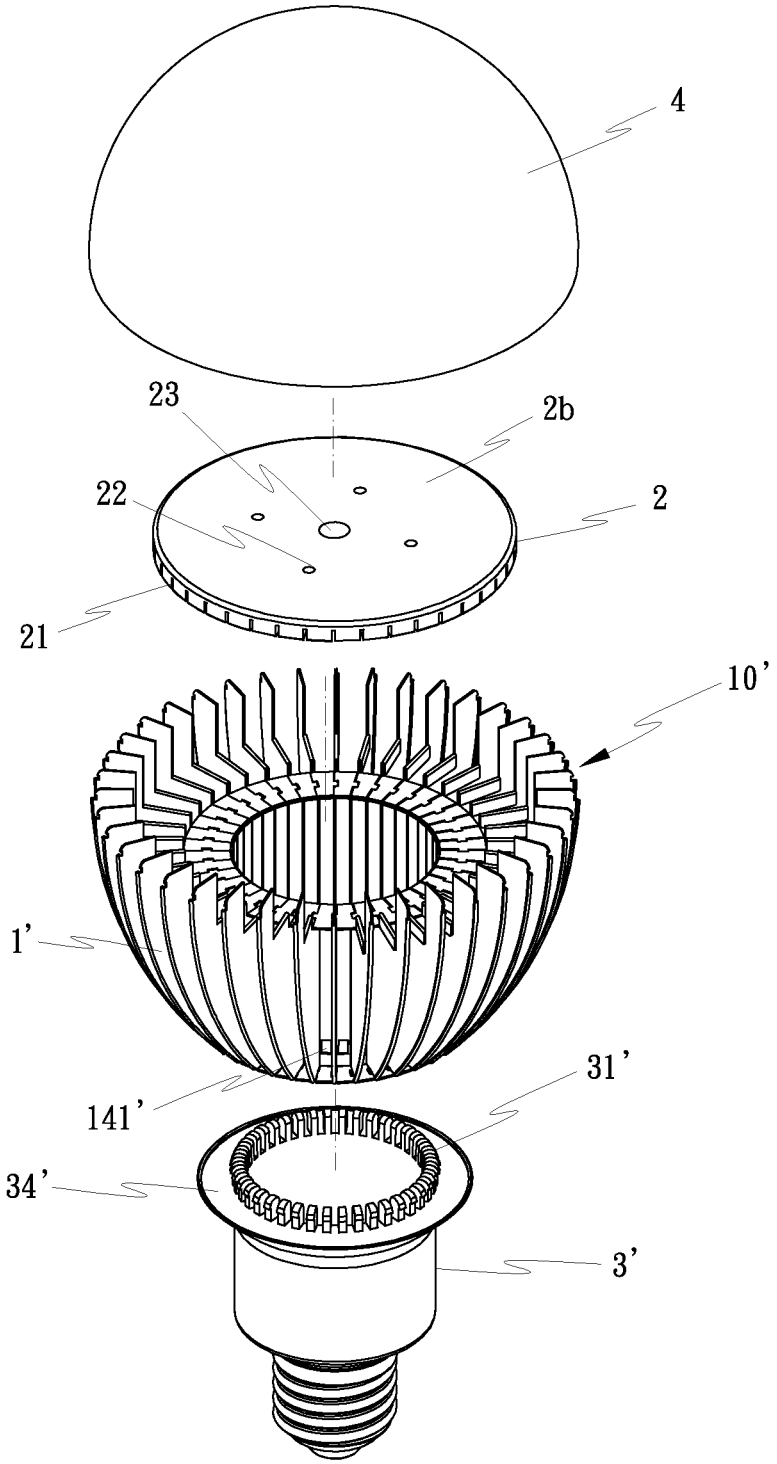
FIG. 12 is an exploded view of the alternate form of the LED lamp assembly in accordance with the present invention.

FIGS. 11 and 12 illustrate an alternate form of the LED lamp assembly in accordance with the present invention. According to this alternate form, each radiation fin 1' comprises a narrow, elongated mounting flange 14' perpendicularly extending from an inner side thereof, and an inner locating notch 141' located at the narrow, elongated mounting flange 14' near a bottom side. After the radiation fins 1' and the heat-sink base 2 are affixed together, the narrow, elongated mounting flange 14' of the radiation fins 1' are abutted against one another.

Further, the insulative connector 3' in accordance with this alternate form comprises a rim 34' extending around the periphery of a top side thereof and stopped against the radiation fins 1' of the radiation fin set 10' at a bottom side, and a plurality of hook rods 31' protruding from an inner perimeter of the rim 34' and respectively hooked in the inner locating notches 141' of the radiation fins 1' of the radiation fin set 10'.

Further, the configuration of the insertion notches 21 of the heat-sink base 2 can be changed according to change in the configuration of the plug portions 11 of the radiation fins 1. For example, the insertion notches 21 of the heat-sink base 2 can be curved to fit curved configuration of the plug portions 11 of the radiation fins 1. Further, the plug portions 11 of the radiation fins 1 can be configured to provide a single layer design. Alternatively, the plug portions 11 of the radiation fins 1 can be folded plug portions, providing a multi-layer design.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A LED lamp assembly, comprising a radiation fin set defining a top open side, a heat-sink base mounted in said top open side of said radiation fin set to hold light-emitting diode means, and an insulative connector fastened to said radiation fin set at a bottom side, wherein:

said heat-sink base is a flat metal block member comprising opposing flat outer wall and flat inner wall, and a plurality of insertion notches equiangularly and radially located at said flat inner wall, the insertion notches having a depth smaller than the thickness of the flat metal block member;

said radiation fin set comprises a plurality of radiation fins arranged in a radial array, each said radiation fin comprising a plug portion disposed at a top side thereof and respectively inserted into one respective said insertion notch of said heat-sink base and fixedly secured thereto using a stamping technique;

each said radiation fin of said radiation fin set comprises a narrow, elongated mounting flange perpendicularly extending from an inner side thereof, and an inner locating notch located at said narrow, elongated mounting flange near a bottom side thereof; and said insulative connector comprises a rim extending around the periphery of a top side thereof and stopped against said radiation fins of said radiation fin set at a bottom side, and a plurality of hook rods protruding from said rim and respectively hooked in the inner locating notches of said radiation fins of said radiation fin set.

2. The LED lamp assembly as claimed in claim 1, further comprising a lampshade fastened to said radiation fin set over said top open side.

3. The LED lamp assembly as claimed in claim 1, wherein said heat-sink base comprises a plurality of through holes extending through said flat inner wall and said flat outer wall.

4. The LED lamp assembly as claimed in claim 1, wherein the plug portion of each said radiation fin is a folded plug portion having a folded part, the thickness of the folded plug portion of each said radiation fin being smaller than the width of each said insertion notch of said heat-sink base before insertion, the folded plug portions of said radiation fins being embedded in the respective said insertion notches of said heat-sink base after application of said stamping technique.

5. The LED lamp assembly as claimed in claim 1, wherein each said radiation fin of said radiation fin set has a stepped structure at the top side thereof; the plug portion of each said radiation fin is located at a middle part of the stepped structure of the respective said radiation fin.

6. The LED lamp assembly as claimed in claim 5, wherein each said radiation fin further comprises a horizontal protruding portion located at the stepped structure thereof and abutted against an inner side of the associated plug portion at a relatively lower elevation, the horizontal protruding portions of said radiation fins being respectively horizontally abutted against one another to form an annular plane.

7. The LED lamp assembly as claimed in claim 1, wherein each said radiation fin of said radiation fin set comprises an outer edge, and an upper locating notch located at said outer edge near a top side of said outer edge for mounting a lampshade.

8. The LED lamp assembly as claimed in claim 1, wherein each said radiation fin of said radiation fin set comprises an outer edge, and a lower locating notch located at said outer edge near a bottom side of said outer edge for mounting said insulative connector.

9. A method for making an LED lamp assembly, comprising the steps of:

providing a radiation fin set having a plurality of radiation fins arranged in a radial array, each said radiation fin comprising a plug portion disposed at a top side thereof;

providing a heat-sink base for holding light-emitting diode means, wherein the heat-sink base is a flat metal block member comprising opposing flat outer wall and flat inner wall, and a plurality of insertion notches equiangularly and radially located at the flat inner wall, the insertion notches having a depth smaller than the thickness of the flat metal block member;

inserting the plug portion of each radiation fin into one respective insertion notch of the heat-sink base by stamping the plug portion of each radiation fin into the associated insertion notch of the heat-sink base to fixedly fasten the heat-sink base to the radiation fin set; and fastening an insulative connector to the radiation fin set at a bottom side, wherein each said radiation fin of said radiation fin set comprises a narrow, elongated mounting flange perpendicularly extending from an inner side thereof, and an inner locating notch located at said narrow, elongated mounting flange near a bottom side thereof; said insulative connector comprises a rim extending around the periphery of a top side thereof and stopped against said radiation fins of said radiation fin set at a bottom side, and a plurality of hook rods protruding from said rim and respectively hooked in the inner locating notches of said radiation fins of said radiation fin set.

10. The method for making an LED lamp assembly as claimed in claim 9, further comprising the step of fastening a lampshade to the radiation fin set at a top side.

11. The method for making an LED lamp assembly as claimed in claim 9, wherein said heat-sink base comprises a plurality of through holes extending through said flat inner wall and said flat outer wall.

12. The method for making an LED lamp assembly as claimed in claim 9, wherein the plug portion of each said radiation fin is a folded plug portion having a folded part, the thickness of the folded plug portion of each said radiation fin being smaller than the width of each said insertion notch of said heat-sink base before the inserting step, the folded plug portions of said radiation fins being embedded in the respective said insertion notches of said heat-sink base after the stamping step.

13. The method for making an LED assembly as claimed in claim 9, wherein each said radiation fin of said radiation fin set has a stepped structure at the top side thereof; the plug portion of each said radiation fin is located at a middle part of the stepped structure of the respective said radiation fin.

14. The method for making an LED assembly as claimed in claim 13, wherein each said radiation fin further comprises a horizontal protruding portion located at the stepped structure thereof and abutted against an inner side of the associated plug portion at a relatively lower elevation, the horizontal protruding portions of said radiation fins being respectively horizontally abutted against one another to form an annular plane.

15. The method for making an LED assembly as claimed in claim 9, wherein each said radiation fin of said radiation fin set comprises an outer edge, and an upper locating notch located at said outer edge near a top side of said outer edge for mounting a lampshade.

16. The method for making an LED assembly as claimed in claim 9, wherein each said radiation fin of said radiation fin set comprises an outer edge, and a lower locating notch located at said outer edge near a bottom side of said outer edge for mounting said insulative connector.

* * * * *